United States Patent [19]

Uchida et al.

[11] Patent Number: 5,006,696

[45] Date of Patent: Apr. 9, 1991

[54] FACE-LIKE HEATING DEVICE

[75] Inventors: Katsuyuki Uchida; Hiroto Fujiwara, both of Nagaokakyo, Japan

[73] Assignee: Murata Manufacturing Co., Ltd., Japan

[21] Appl. No.: 390,607

[22] Filed: Aug. 7, 1989

[30] Foreign Application Priority Data

Aug. 26, 1988 [JP] Japan ..... 63-213177

[51] Int. Cl.[5] ..... H05B 3/26

[52] U.S. Cl. ..... 219/505; 219/543; 219/548; 219/553

[58] Field of Search ..... 219/548, 540, 543, 552, 219/553, 505

[56] References Cited

U.S. PATENT DOCUMENTS

| | | | |
|---|---|---|---|
| 3,976,854 | 8/1976 | Ishikawa | 219/540 |
| 4,034,207 | 7/1977 | Tamada | 219/553 |
| 4,037,082 | 7/1977 | Tamada | 219/553 |
| 4,482,801 | 11/1984 | Habata | 219/505 |
| 4,631,391 | 12/1986 | Tiepke | 219/505 |

*Primary Examiner*—Roy N. Envall, Jr.

*Attorney, Agent, or Firm*—Ostrolenk, Faber, Gerb & Soffen

[57] ABSTRACT

Disclosed is a face-like heating device using an organic PTC thermistor plate having at least one pair of electrodes formed on one major surface thereof and a soaking plate made of a material having a thickness in the range of 0.1 mm to 0.3 mm and having thermal conductivity of 0.4 cal $cm^{-1}$ $S^{-1}$ $deg^{-1}$ or higher adhered to the other major surface thereof.

5 Claims, 2 Drawing Sheets

FACE-LIKE HEATING DEVICE

BACKGROUND OF THE INVENTION

1 Field of the Invention

The present invention relates to a face-like heating device using a sheet-like organic positive temperature coefficient (PTC) thermistor.

2 Description of the Prior Art

An organic PTC thermistor plate obtained by thoroughly mixing organic polymer materials such as polyolefin, for example, polyethylene, with conductive particles such as carbon black, graphite or metal powder and forming the same into a sheet has a positive temperature coefficient at zero-power of the resistance. Conventionally, an organic PTC thermistor having a structure, in which a pair of electrodes are formed on one surface of the above described organic PTC thermistor plate (obtained by thoroughly mixing organic polymer materials with conductive particles and forming the same) and a soaking plate (i.e., a plate for making the heat uniform) is adhered to the other surface thereof, has been widely utilized as a face-like heating device, making use of, flexibility which is an advantage of the organic PTC thermistor.

In the face-like heating device using the organic PTC thermistor plate, the soaking plate must be made thicker than necessary when the thermal conductivity of the soaking plate is low. Thus, the face-like heating device cannot make use of the flexibility of the sheet-like organic PTC thermistor and is not satisfactory in terms of thermal conduction and thermal efficiency.

When the thickness of the soaking plate is decreased, the flexibility of the organic PTC thermistor plate can be made use of but satisfactory soaking characteristics cannot be obtained.

On the other hand, when the thickness of the soaking plate is increased, soaking characteristics are improved but the flexibility of the organic PTC thermistor plate cannot be made use of. Furthermore, in this case, the thermal capacity of the soaking plate itself is increased. Thus, more time than necessary is required to raise the temperature of the soaking plate and consequently, thermal efficiency is inherently reduced.

SUMMARY OF THE INVENTION

Accordingly, the present invention has been made to solve the above described problems and has for its object to provide a face-like heating device capable of making use of the flexibility of an organic PTC thermistor plate and having a soaking plate with superior soaking characteristics.

The present invention provides a face-like heating device comprising a sheet-like orgnaic PTC thermistor, at least one pair of electrodes formed on one major surface of the organic PTC thermistor and a soaking plate adhered to the other major surface thereof, the thickness of the soaking plate being in the range of 0.1 mm to 0.3 mm and the soaking plate being made of a material having thermal conductivity of 0.4 cal $cm^{-1}$ $S^{-1}$ $deg^{-1}$ or higher.

In the face-like heating device according to the present invention, the thickness of the soaking plate is set in the range of 0.1 mm to 0.3 mm and the thermal conductivity of the material forming the soaking plate is 0.4 cal $cm^{-1}$ $S^{-1}$ $deg^{-1}$ or higher. Accordingly, the soaking characteristics of the soaking plate are improved without losing the flexibility of the organic PTC thermistor plate.

Furthermore, the thermal capacity of the soaking plate itself is not substantially increased, so that the time required to raise the temperature of the soaking plate is shortened. Accordingly, thermal efficiency can be improved.

The soaking plate is made of a material superior in thermal conduction. In a particular example, the soaking plate is constituted by an aluminium alloy having thermal conductivity x where, $0.400 \leqq x \leqq 0.55$ cal $cm^{-1}$ $S^{-1}$ $deg^{-1}$.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
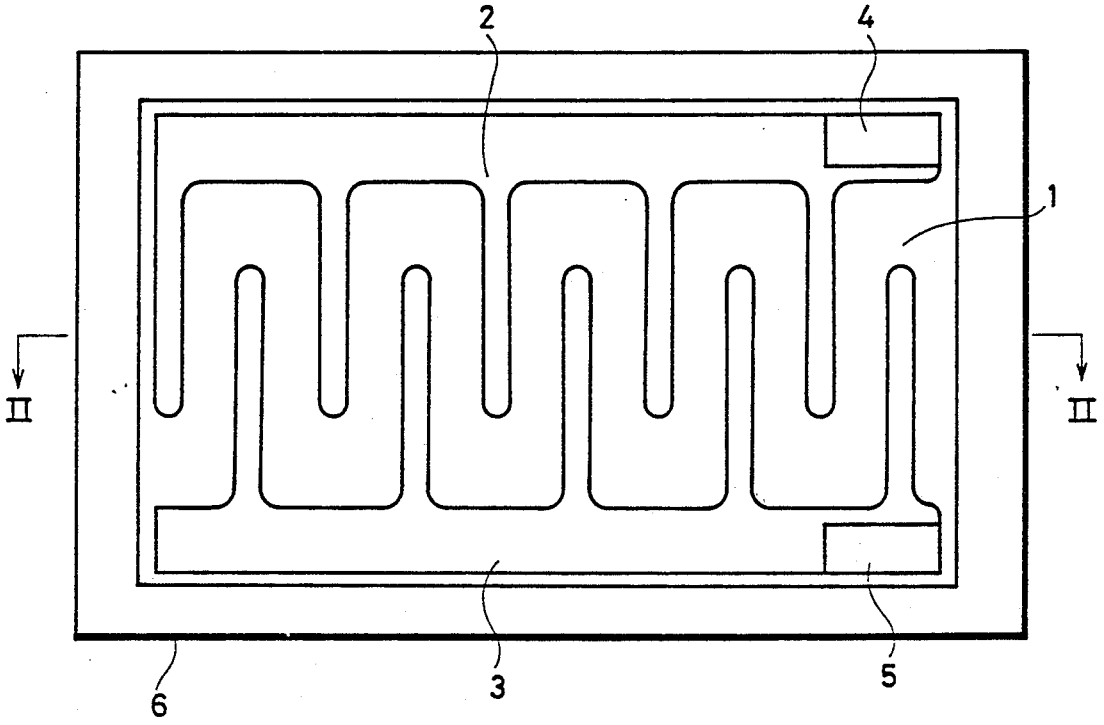
FIG. 1 is a plan view showing a face-like heating device according to an embodiment ot the present invention.
Figure 2:
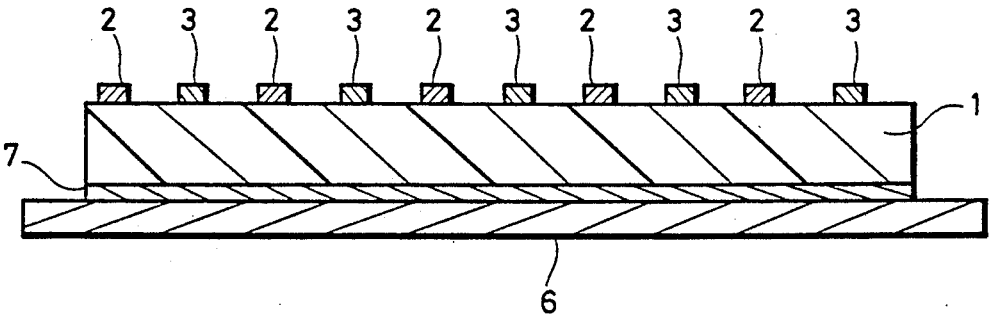
FIG. 2 is a sectional side elevation view taken along a line II—II shown in FIG. 1.

FIG. 1 is a plan view showing a face-like heating device according to an embodiment of the present invention, and FIG. 2 is a sectional side elevation view taken along a line II—II shown in FIG. 1.

An organic PTC thermistor plate 1 is obtained by thoroughly mixing polymer materials such as polyolefin, for example, polyethylene, with conductive particles such as carbon black, graphite or metal powder and then, forming the same into a sheet by a heat press process. A pair of comb-shaped electrodes 2 and 3 are formed on one (first) surface of this organic PTC thermistor plate 1. The comb-shaped electrodes 2 and 3 are formed of conductive pastes mainly composed of silver, copper or nickely by a known method of forming electrodes such as screen process printing.

Terminals 4 and 5 for making electrical connection to the exterior are respectively fixed to the comb-shaped electrodes 2 and 3.

A soaking plate 6 is adhered to the other (second) major surface of the organic PTC thermistor plate 1. The soaking plate 6 is made of a material superior in thermal conduction such as aluminium. In the present embodiment, a pressure sensitive adhesive double coated tape 7 is used to adhere the soaking plate 6 to the organic PTC thermistor plate 1. The size of the soaking plate 6 is made larger than the area of the second major surface of the organic PTC thermistor plate 1. Embodiment of the invention and comparison examples will now be described.

Face-like heating devices in the following embodiments 1 to 3 and comparison example 1 to 4 are fabricated according to the above described structure using the following soaking plates of various sizes and materials. DC current of 16 V is caused to flow through each of the soaking plates, to measure the temperatures at the centers and at the ends of the soaking plates and the power used.

EMBODIMENT 1

The face-like heating device in the embodiment 1 is adapted such that the organic PTC thermistor plate 1 is made of a material 40×100×0.1 mm in size, and the soaking plate 6 is constituted by an aluminium plate 80×150×0.1 mm in size. The thermal conductivity of this aluminium plate is 0.487 cal $cm^{-1}$ $S^{-1}$ $deg^{-1}$.

EMBODIMENT 2

The face-like heating device in the embodiment 2 is the same as that in the embodiment 1 except that the thickness of the soaking plate 6 is set to 0.2 mm.

EMBODIMENT 3

The fact-like heating device in the embodiment 3 is the same as that in the embodiment 1 except that the thickness of the soaking plate 6 is set to 0.3 mm.

COMPARISON EXAMPLES 1 to 3

The face-like heating devices in the comparison examples 1 to 3 are in the same shape and made of the same material as those of the face-like heating device in the embodiment 1 except that the thicknesses of the soaking plates 6 are respectively set to 0.05 mm, 0.4 mm and 0.5 mm.

COMPARISON EXAMPLE 4

The face-like heating device in the comparison example 4 is the same as that in the embodiment 2 except that the soaking plate 6 is made of iron in place of aluminium. In this comparison example 4, the thermal conductivity of iron making the soaking plate 6 is 0.15 cal $cm^{-1}$ $S^{-1}$ $deg^{-1}$.

Figure 3:
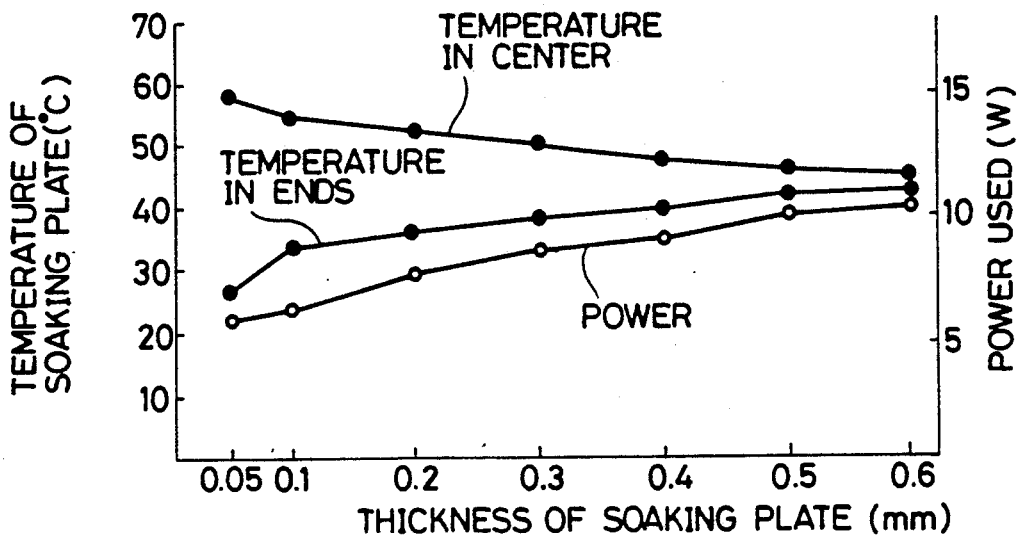
FIG. 3 is a characteristic curve showing the results of measurements of the temperature at the center and at the ends of a soaking plate and the power used with respect to several types of face-like heating devices.

The results of measurements of the temperatures at the centers and at the ends of the soaking plates and the power used with respect to the face-like heating devices of the embodiments 1 to 3 and the comparison examples 1 to 4 are shown in the following Table 1 and FIG. 3.

TABLE 1

| | Material of Soaking Plate | Thickness of Soaking Plate | Temperature in Center of Soaking Plate | Temperature in Ends of Soaking Plate | Power used |
|---|---|---|---|---|---|
| Embodiment 1 | aluminium | 0.1 mm | 55.3° C. | 34.2° C. | 6.9 w |
| Embodiment 2 | aluminium | 0.2 mm | 53.0° C. | 36.7° C. | 7.7 w |
| Embodiment 3 | aluminium | 0.3 mm | 50.7° C. | 39.2° C. | 8.2 w |
| Comparison Example 1 | aluminium | 0.05 mm | 58.3° C. | 26.9° C. | 5.6 w |
| Comparison Example 2 | aluminium | 0.4 mm | 48.9° C. | 40.2° C. | 9.1 w |
| Comparison Example 3 | aluminium | 0.5 mm | 47,1° C. | 40.9° C. | 9.9 w |
| Comparison Example 4 | iron | 0.2 mm | 55.1° C. | 29.3° C. | 6.8 w |

From Table 1, the following have become clear. If the thickness of the soaking plate 6 is decreased, the difference between the temperature at the center and at the ends of the soaking plate is increased, so that the soaking characteristics are degraded. On the other hand, if the thickness of the soaking plate 6 is increased, the power used is increased, so that the effect of whereby the temperature of the soaking plate is raised depending on the increase in power consumption is reduced.

Fruthermore, if the soaking plate 6 is made of a materaial having low thermal conductivity, satisfactory soaking characteristics cannot be obtained, so that the difference between the temperatures at the center and at the ends of the soaking plate is further increased.

Figure 4:
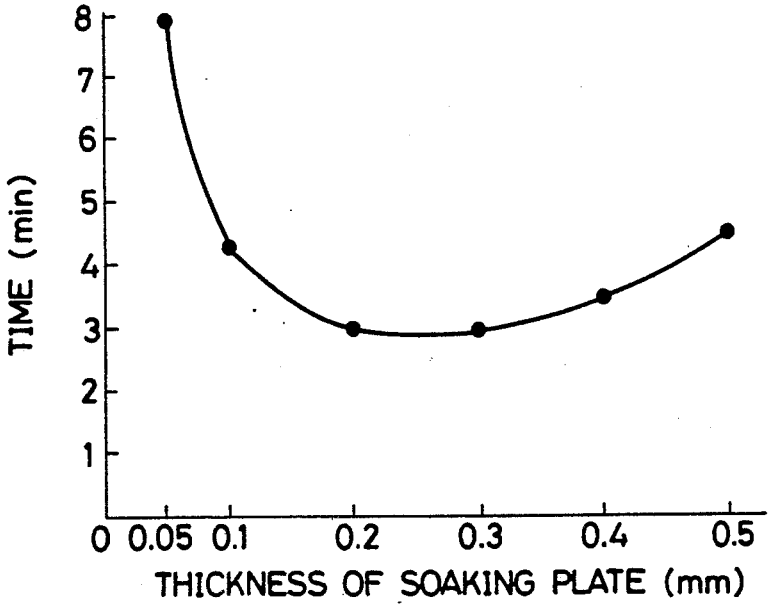
FIG. 4 is a characteristic curve showing the relation between the time when the temperature at the ends of the soaking plate exceeds 0° C. and the thickness of the soaking plate.

DC current of 16 V is then caused to flow through each of the soaking plates 6 of different thicknesses at a temperature of −30°C., to measure the speed at which the temperature of the soaking plate is raised. The results are shown in FIG. 4. FIG. 4 is a diagram showing the relation between the time when the temperature at the ends of the soaking plate exceeds 0° C. and the thickness of the soaking plate.

As can be seen from FIG. 4, when the thickness of the soaking plate is too small or too large, the temperature of the soaking plate cannot be efficiently raised in a short time.

The results of the above described two measurements show that it is necessary that the thickness of the soaking plate 6 is in the range of 0.1 to 0.3 mm and the soaking plate 6 is made of a material having thermal conductivity of 0.4 cal $cm^{-1}$ $S^{-1}$ $deg^{-1}$ or higher so as to achieve a face-like heating device in which the soaking charactreristics of the soaking plate are high and the effect of raising the temperature thereof is large while making use of the flexibility of the organic PTC thermistor plate 1.

Preferably, the soaking plate 6 is made of a material having thermal conductivity x where, $0.400 \leqq x \leqq 0.55$ cal $cm^{-1}$ $S^{-1}$ $deg^{-1}$.

Although in the above described embodiments, description was made of a face-like heating device having a structure in which the pair of comb-shaped electrodes 2 and 3 is formed on one major surface of the organic PTC thermistor plate 1, the shape of the electrodes in the present invention is not limited to the above described comb-shaped electrodes. More specifically, the present invention can be also applied to a face-like heating device in which electrodes are in various conventionally used shapes.

Although in the above described embodiment, description was made of a case in which a pair of electrodes is formed on one major surface of an organic PTC thermistor plate, it should be noted that two or more pairs of electrodes may be formed to generate heat.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A face-like heating device comprising:

a sheet-like organic positive temperature coefficient (PTC) thermistor having two major surfaces, at least one pair of electrodes formed on one major surface of said organic PTC thermistor, and a soaking plate adhered to the other major surface of said organic PTC thermistor, the thickness of said soaking plate being in the range of 0.1 mm to 0.3 mm, the soaking plate being formed of a material having a thermal conductivity of 0.4 cal $cm^{-1} s^{-1} deg^{-1}$ or higher.

2. The face-like heating device according to claim 1, wherein said thermal conductivity is in the range of 0.40 to 0.55 cal $cm^{-1} S^{-1} deg^{-1}$.

3. The face-like heating device according to claim 1, wherein said soaking plate is made of aluminium.

4. The face-like heating device according to claim 1, wherein said at least one pair of electrodes are interdiqitated comb-shaped electrodes.

5. The face-like heating device according to claim 1, wherein the area of said adhered major surface of said soaking plate is larger than the area of the major surface of the organic PTC thermistor plate which has the soaking plate adhered thereto.

* * * * *